US006311876B1

(12) United States Patent
Liu

(10) Patent No.: US 6,311,876 B1
(45) Date of Patent: Nov. 6, 2001

(54) GREASE ATOMIZING NOZZLE

(76) Inventor: Hung-Yang Liu, P.O. Box 7-820, Taipei (TW)

( * ) Notice: Subject to any disclaimer, the term of this patent is extended or adjusted under 35 U.S.C. 154(b) by 0 days.

(21) Appl. No.: 09/523,972

(22) Filed: Mar. 13, 2000

(51) Int. Cl.[7] ..... B65D 83/00
(52) U.S. Cl. ..... 222/402.1; 222/402.18; 222/394
(58) Field of Search ..... 222/402.1, 394, 222/402.18

(56) References Cited

U.S. PATENT DOCUMENTS

| | | | | |
|---|---|---|---|---|
| 4,417,674 | * | 11/1983 | Giuffredi | 222/402.18 |
| 4,477,023 | * | 10/1984 | Gates | 239/340 |
| 4,511,069 | * | 4/1985 | Kalat | 222/263 |
| 4,685,597 | * | 8/1987 | Hirao et al. | 222/389 |
| 5,211,317 | * | 5/1993 | Diamond et al. | 222/394 |
| 5,881,929 | * | 3/1999 | Coerver, Jr. | 222/402.1 |
| 6,092,698 | * | 7/2000 | Bayer | 222/402.25 |

FOREIGN PATENT DOCUMENTS

| | | | | |
|---|---|---|---|---|
| 0445358 | * | 11/1991 | (EP) | B65D/83/44 |
| 2057582 | * | 4/1981 | (GB) | F16K/21/00 |

* cited by examiner

*Primary Examiner*—Kevin Shaver
*Assistant Examiner*—Frederick Nicolas

(57) ABSTRACT

A grease atomizing nozzle comprises a jet tube with a concave ring shaped depression at a middle section thereof. Two tapered holes with large openings facing outwards are formed at the ring. A jet opening penetrates through a top side of the jet tube. A lower end of the opening is perpendicular to the tapered holes. A lower end of the jet tube is formed with a tapered surface which applies a pressure to a resilient spring tberebelow. A seat below the jet tube is a cylindrical body with a cavity formed therein. A plurality of concave trenches radially spaced are formed in the cavity. These trenches are perpendicular to an inner surface of the cavity; and a gas inlet being formed at an upper side of the cavity.

1 Claim, 6 Drawing Sheets

B-B

A-A

GREASE ATOMIZING NOZZLE

BACKGROUND OF THE INVENTION

The present invention relates to a grease atomized nozzle, and especially to an atomized nozzle having a better circulation for material therein.

Grease is usually used for lubricating mechanical components so as to assure the components not to rust, such as used in bearings, rollers, motorcycles, cars, etc. However, in the prior designs, grease is coated on a component by bands so that the distribution is not uniform, some locations in the tip portions are not coated, further, the non-uniform grease will be formed as blocks, thereby, causing the operation of the components not to be smooth.

SUMMARY OF THE INVENTION

The main object of the present invention is to provide a grease atomizing nozzle, where two tapered holes and a gas inlet are provided to increase the circulation of material therein.

Another object of the present invention is to provide a grease atomizing nozzle wherein two tapered holes with large opening facing outwards are formed at the ring shaped depression. A plurality of concave trenches longitudinally spaced are formed in the cavity so the material may transfer and flows therein.

Another feature of the present invention is to provide a grease atomizing nozzle, wherein two tapered holes have reduced configuration so the material can concentrate into the tube so the material can be formed with an enhance gas flow. Then, by the gas inlet the material in the tube may further enforced.

DETAILED DESCRIPTION OF THE PREFERRED EMBODIMENT

Figure 1:
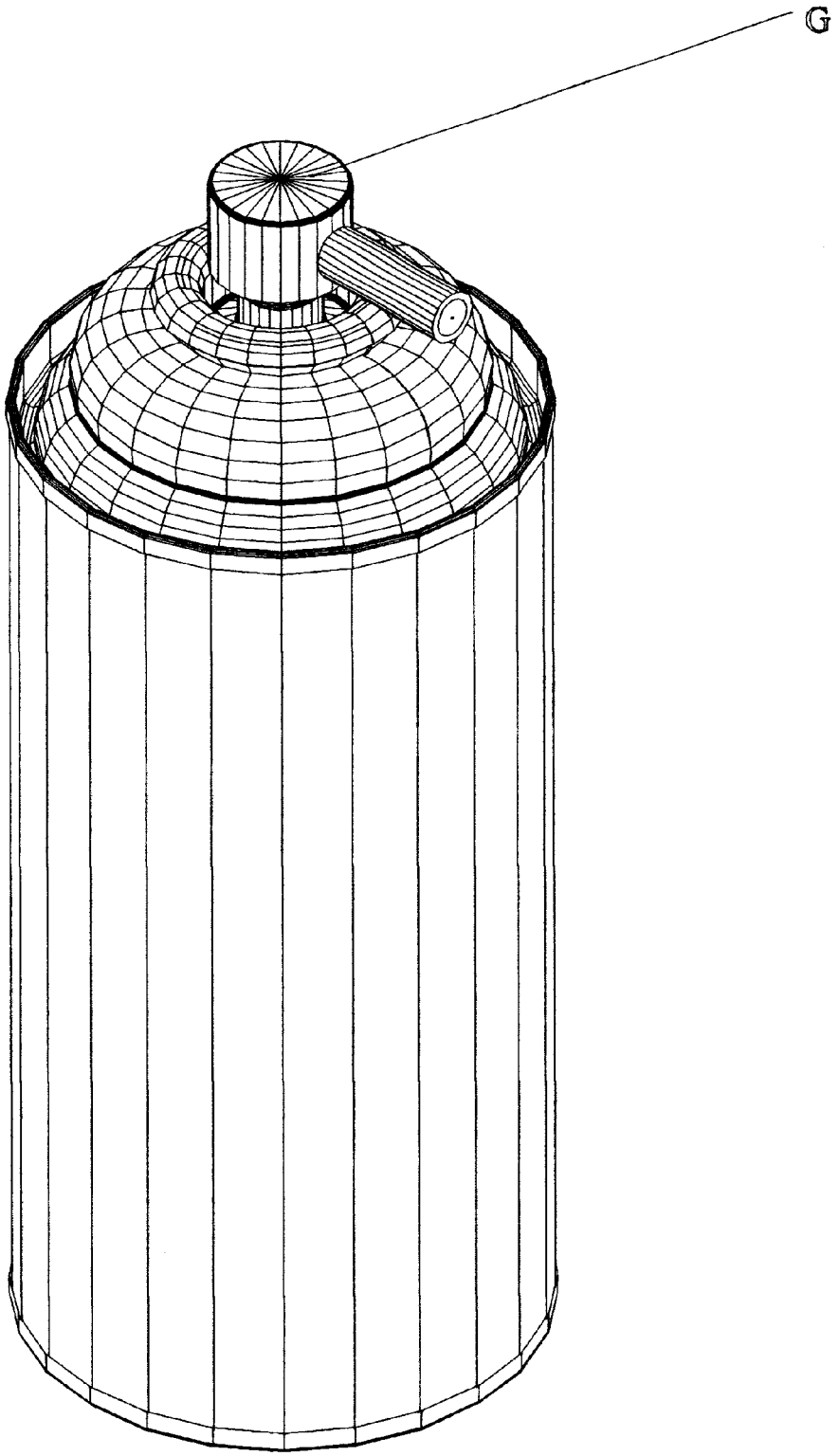
FIG. 1 is a schematic view of the present invention.
Figure 2:
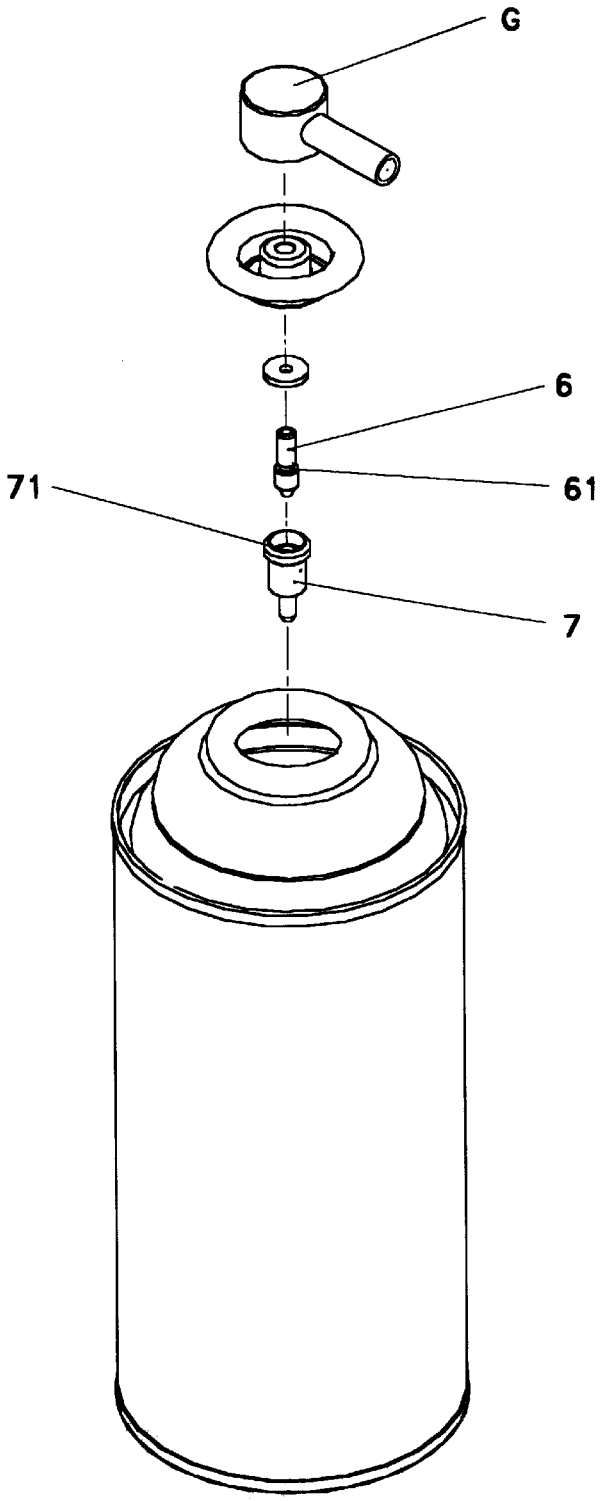
FIG. 2 is a perspective view of the present invention.
Figure 3:
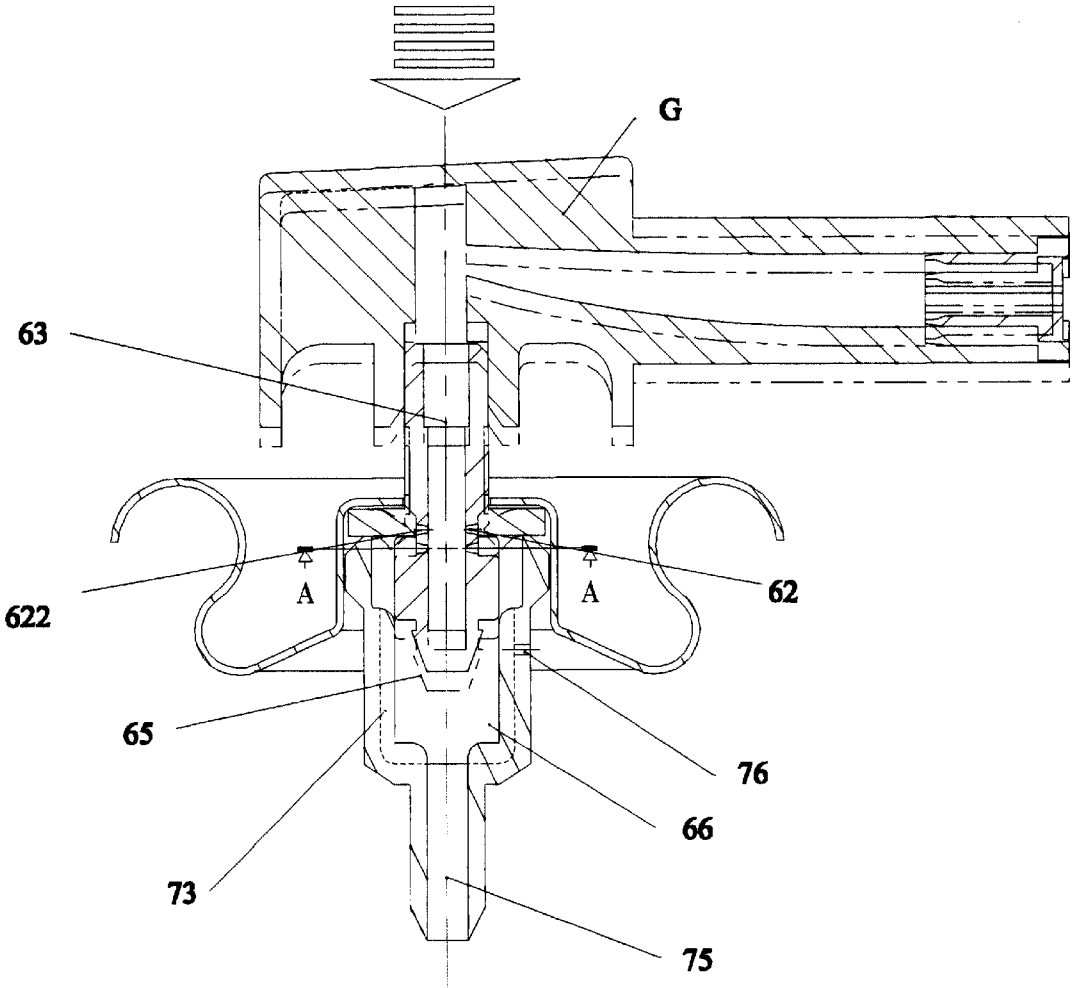
FIG. 3 is a cross sectional view of the present invention.
Figure 4:
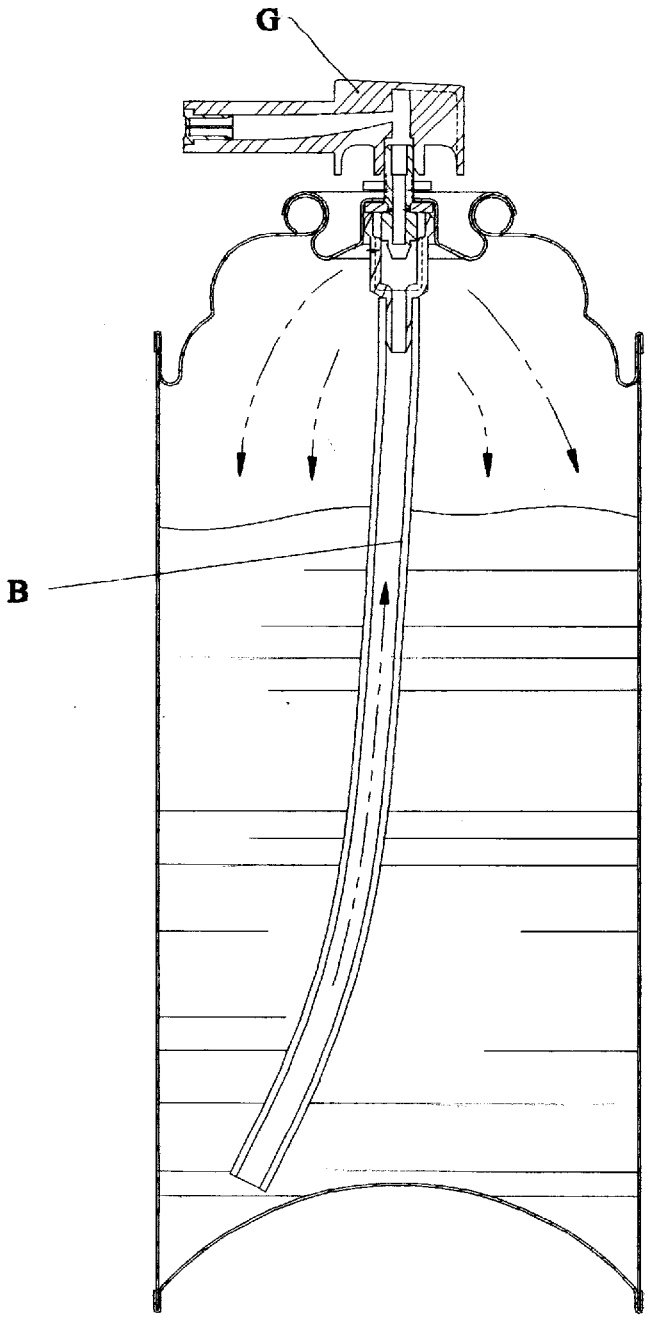
FIG. 4 is another cross sectional view of the present invention.
Figure 5:
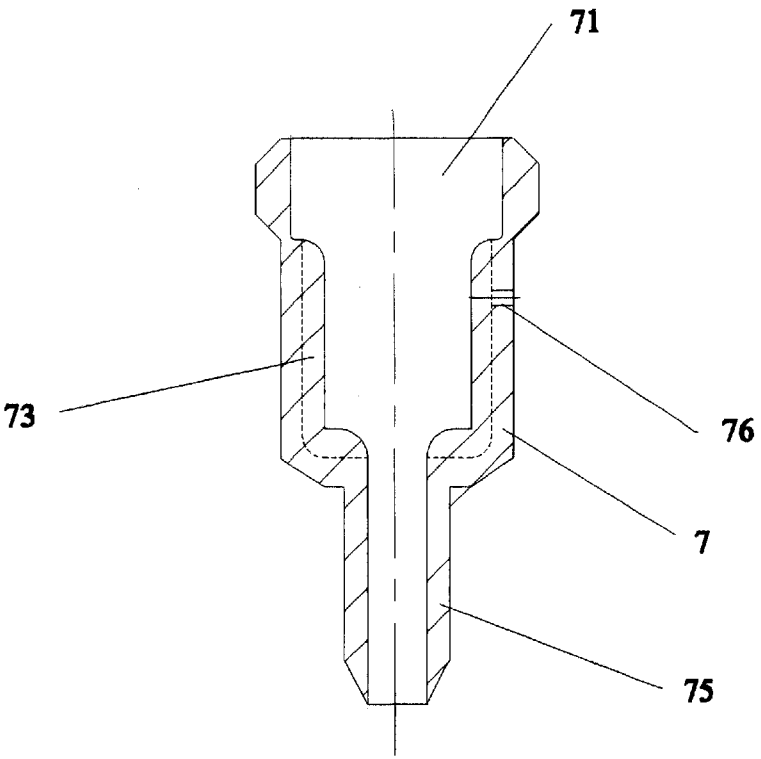
FIG. 5 is a perspective view showing the trenches and gas inlet of the present invention.
Figure 5:
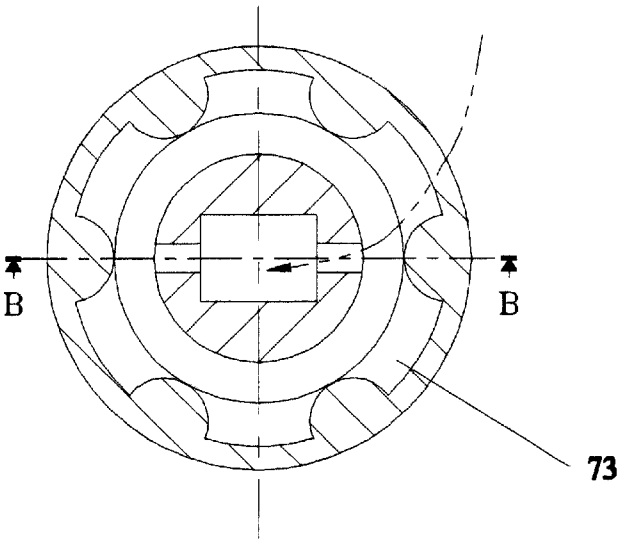
Figure 6:
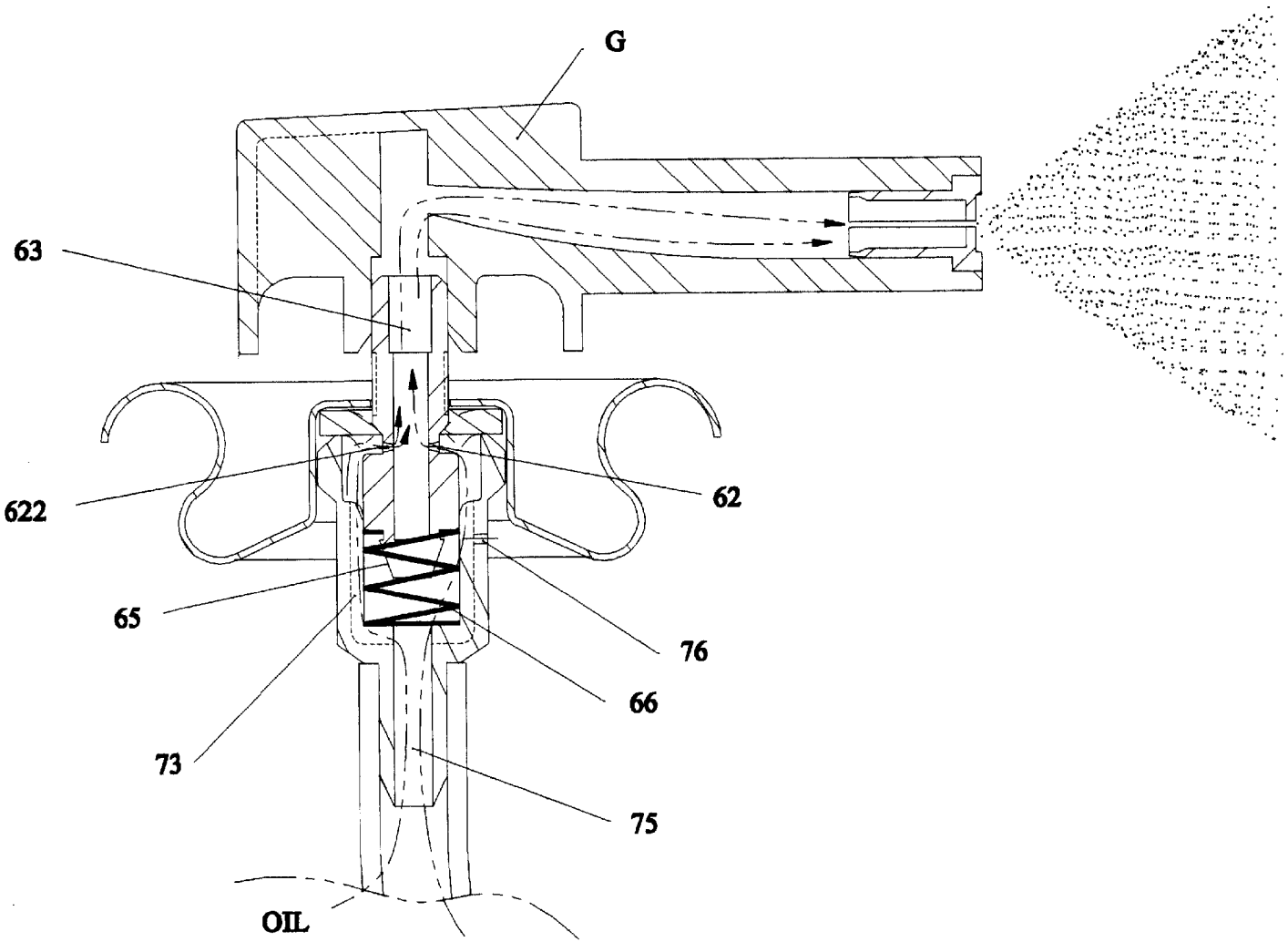
FIG. 6 is a schematic viewing showing the spraying operation of the present invention.

With reference to the drawings and in particular to FIGS. 1 through 6, the atomizing nozzle of the present invention includes a jet tube 6 with a concave ring shaped depression 61 at the middle section. Two tapered holes 62, 622 with larger openings facing outward are formed at the ring shaped depression 61. A jet opening 63 penetrating through the upper side of the jet tube 6 is formed. Two lower end of the opening 63 is perpendicular to the tapered holes 62, 622. The lower end of the tube is a tapered surface 65, which presses above the resilient spring 66. The lower end of the spring presses against the chamber. The seat 7 is a funnel type cylinder. A cavity 71 is formed in the cylinder. A plurality of concave trenches 73 longitudinally spaced are formed in the cavity. The trenches are perpendicular to the inner surface of the cavity, and gas may flow therein so that material can flow into the cavity from the lower end via hole 75. Moreover, the gas inlet 76 may be passed by gas successfully. When cap G presses the tapered surface 65, the resilient spring 66 will be pressed so as to drive the gas in the tube. Then, the material flows from dip tube 9 and enters into hole 75. Then, the material is dispersed into the trenches 73 so as to further flow to the tapered hole 62, 622. Thus, material flows to the opening 63. The gas inlet 76 has the function of assisting the material to flow successfully.

I claim:

1. A grease atomizing nozzle comprising a jet tube with a concave ring shaped depression at a middle section thereof; two tapered holes with large openings facing outwards being formed at the ring depression; a jet opening penetrating through a top side of the jet tube; a lower end of the opening perpendicular to the tapered holes; a lower end of the jet tube being formed with a tapered surface which applies a pressure to a resilient spring therebelow; a seat below the jet tube being a cylindrical body with a cavity formed therein; a plurality of concave trenches longitudinally spaced being formed in the cavity; said trenches being perpendicular to an inner surface of the cavity; and a gas inlet being formed at an upper side of the cavity.

* * * * *